United States Patent [19]

Fasterding et al.

[11] Patent Number: 4,802,623

[45] Date of Patent: Feb. 7, 1989

[54] CONCRETE CROSS SLEEPER SYSTEM

[75] Inventors: Günter Fasterding, Ilsede; Jürgen Frenzel, Freden, both of Fed. Rep. of Germany

[73] Assignee: Stahlwerke Peine-Salzgitter AG, Peine, Fed. Rep. of Germany

[21] Appl. No.: 60,039

[22] Filed: Jun. 9, 1987

[30] Foreign Application Priority Data

Jun. 10, 1986 [DE] Fed. Rep. of Germany ..... 3619417

[51] Int. Cl.[4] ..... F01B 9/04

[52] U.S. Cl. ..... 238/44; 238/85; 238/106; 238/283; 238/315; 238/349; 238/351

[58] Field of Search ..... 238/44, 83, 84, 85, 238/86, 283, 284, 2, 106, 285, 264, 310, 315, 338, 343, 349, 351; 106/97, 99

[56] References Cited

U.S. PATENT DOCUMENTS

| | | | |
|---|---|---|---|
| 618,566 | 1/1899 | Gereckey | 238/284 |
| 1,406,074 | 2/1922 | Pierson | 238/283 |
| 1,520,987 | 12/1924 | Waples | 238/106 |
| 2,425,883 | 8/1947 | Jackson | 106/99 |
| 3,021,291 | 2/1962 | Thiessen | 106/97 |
| 3,190,607 | 6/1965 | Sonneville | 238/84 |
| 4,285,115 | 8/1981 | Frenzel | 29/460 |
| 4,632,307 | 12/1986 | Weber | 238/283 |
| 4,648,554 | 3/1987 | McQueen | 238/283 |

FOREIGN PATENT DOCUMENTS

| | | | |
|---|---|---|---|
| 0154259 | 9/1985 | European Pat. Off. | 238/84 |
| 839363 | 5/1952 | Fed. Rep. of Germany | 238/106 |
| 2802145 | 8/1978 | Fed. Rep. of Germany . | |
| 3223305 | 12/1983 | Fed. Rep. of Germany . | |
| 40591 | 9/1908 | Switzerland . | |
| 861473 | 2/1961 | United Kingdom . | |

OTHER PUBLICATIONS

"Lichtbogenbolzenschweissen mit Hubzündung", Merkblatt DVS 0902, DVS, Technischer Ausschuss, Arbeitsgruppe UG 9.2, Bolzenschweissen, Dec. 1972.

*Primary Examiner*—Robert B. Reeves
*Assistant Examiner*—Frank Williams
*Attorney, Agent, or Firm*—Nils H. Ljungman

[57] ABSTRACT

Modern D.C.-tractioned trains and track circuit signal systems as well as high load trains need a special track construction. A new concrete cross sleeper system is provided for high load and high velocity tracks as well as for urban rapid transit systems comprising rails and sleepers having center part, connected to bar shaped ends and having reinforcing means.

On the bar shaped ends two rail seats for each rail are positioned having elastic, electrically non-conducting plastic pads. The rails are fastened onto the rail seat by special tension means clamping the foot of the rail and fixed into plugs in the sleepers. This feature allows a triple point fixing of the rail at each sleeper end. Tracks on asphalt pavement may be secured by anchor device of the general type as sold under the trademark NELSON.

The new track construction decreases the intermittent load of the rail/sleeper system and avoids trouble in track circuit signal systems existing in normally used prestressed concrete sleepers (FIG. 1).

17 Claims, 3 Drawing Sheets

CONCRETE CROSS SLEEPER SYSTEM

BACKGROUND OF THE INVENTION

The invention relates to a concrete cross sleeper system for railways comprising rails and sleepers bedded onto asphalt pavement or broken stone ballast.

DESCRIPTION OF THE PRIOR ART

From the German Offenlegungsschrift DE-OS No. 32 23 305 a concrete cross sleeper is known comprising bar shaped ends, a rail seat, plugs, and tension means for drawing the foot of the rail onto only one rail seat on a bar shaped end. On the rail seat a plastic pad is located for bearing the rail elastically. The tension means consists of a spring and a coach screw with a flanged head and a threaded end.

Another type of a concrete sleeper system is described in the Swiss Pat. No. 40 591 with sleepers having rail supporting parts with two rail seats on each end and a center part. The supporting parts are running under the rails, and the length of these parts and the pitch of the sleepers are chosen in that way that the rail seats have a constant distance between each other. The sleeper has a system of iron-rods for reinforcing of the center part and the supporting parts. The tension means consist of bolts with nuts and washers.

The German Offenlegungsschrift DE-OS No. 28 02 145 (inventor was Jürgen Frenzel, one of the present inventors) shows a concrete sleeper system for railways with Y-shaped sleepers of which each has a Y-shaped center part and three bar shaped ends. The sleepers have reinforcement means of steel rods.

Rail fastening clips sold under the trademark PANDROL with basic metal plates for rail seats on sleepers are described in the British Pat. No. 861 473, first.

Fastening elements with anchor bolt systems of a type which are sold under the trademark NELSON is described in the Merkblatt DVS 0902, Dec. 1972 of the German Association of Welding Technicians.

BRIEF SUMMARY OF THE INVENTION

It is a subject of the invention to improve a concrete cross sleeper system for railways bedded on an asphalt pavement or on broken stone ballast. In that way that low bearing pressure to the ground and the sleeper system is achieved although high dynamic load forces the system. Especially low dipping in broken stone ballast beds, reducing the bending stress in the rails and optimizing the torsion stress and the alternate bending stress in the sleeper are other objects of the present invention.

A further subject of the invention is to improve the concrete cross sleeper system for operating with track circuit signal system without any disturbances from vagabond current due to electrically conducting sleeper systems.

A concrete cross sleeper system according to the present inventin comprises rails and sleepers. The sleepers have bar shaped ends with at least two rail seats on each end and tension means which are located in the middle between two rail seats for drawing the foot of the rail onto the rail seasts. This feature is evident for the invention because the double-bearing of the rail with the tensioning between it results in an optimum triple point fixing of the rail on each end of the sleeper.

To avoid large ends of the sleeprs as in the state of the prior art and therefrom resulting very heavy and crack sensible construction reinforcing means are necessary, and the enlargement of the width of the bar shaped end should be limited to the double of the height of the sleepers.

Practice has shown that there is an advantageous range in the relationship between the pitch of the sleepers and the distance between two rail seats which means the rigidity of the track on one side and a favorable dynamic behavior and the carrying capacity of the track.

The ratio of the distance between two rail seats on one bar shaped end of the sleeper and the distance between two axes of sleeper ends alongside the rail should be more than 20 percent.

The sleeper system according to the invention achieving a relevant decreasing of bending and tension stress in the rail with the additional result of low tilting of the sleepers when a train rolls across the sleeper.

If in combination with the before mentioned advantages of the sleeper system a Y-shaped sleeper having two bar shaped ends for supporting one rail and one bar shaped end for supporting the other rail is used the total weight per mile of the sleeper system could be reduced by about 20% with even or better bearing of the rails.

A very simple possibility to build the rail seats at the bar shaped end according to the invention is the method to mould two concrete saddles while moulding the whole sleeper. Onto these saddles and underneath the rail a plastic pad is positioned to support the rail elastically and avoid vibrations of the rail from the sleeper.

According to another object of the invention the rail seat consists of a basic metal plate secured by screws in plugs of the sleeper.

This basic metal plate covers the total area on the sleeper under the rail and somewhat beside both sides of the foot of the rail. The two rail seats then will be built with two plastic pads of , for instance, polyethylene material to support the rail elastically and isolate the rail electrically non-conducting against the basic metal plate. Special railroads are built on a ground of asphalt pavement. This surface allows no elastic dipping of the sleepers when a train passes them. In this case the dipping activity which is necessary for an elastic behavior of the rails under high load is taken over by the plastic pads.

In the sleeper systems according to the invention the normally used coach screws with flanged head and threaded ends fixed could be provided for fixing a spring at one end on the foot of the rail and at the other end on the surface of the sleeper.

In special circumstances, for instance, in case of repairing an existing track by inserting the inventive sleepers, rail fastening clips sold under the trademark PANDROL which acts as tension means are usable with the sleeper system according to the invention, especially in cooperation with rail seats having the basic metal plate.

A special feature of the invention is to include new reinforcement means into the sleepers. To achieve enough stability of the sleeper although the track as whole has to be an elastic one may use a reinforced sleeper consisting of cement, sand, and an addition of 4 to 10% of polymeric material such as polyvinylacetate. These materials are mixed with water and the mixture is moulded in a moulding form to get a concrete sleeper.

For strong requirements concrete with reinforcement of fibers in chopped length or in layers could be used according to the invention. The technological characteristics of sleepers made of concrete and fibers, for instance, of carbon, glass or steel are much better than the properties of sleepers of pure concrete or prestressed concrete. If necessary, a reinforcing can be specially built by prior investigating of the stresses by optical or mathematical stress-analysis.

Such reinforcing techniques have the advantage that conductive materials which could produce disturbances within the track circuit control installation by induction or conductivity (electrolytic formation in case of rain water between rail and sleeper and between the sleeper and sleeper reinforcement) will be avoided.

Also the interference of the magnetic field of D.C.-driven vehicles through the sleeper system can be excluded.

For increasing the cross shifting resistance, especially on asphalt beds, the new concrete cross sleepers are to be connected with the underground by anchor devices of the general type as sold under the trademark NELSON. This measurement ameliorates the rigidity of the sleeper system. Cross shifting results from centrifugal forces which is caused by the train passing the curve.

A special configuration of the invention renders a further advantage. By integration of the plugs or the dowel-traverse or/and the fastening hole for the anchor device of the general type as sold under the trademark NELSON into the reinforcing means the reinforcement of the sleeper will be increased, especially at high loaded points. This can be realized by using, for instance, fiber-ropes or plastic bridges of polyethylene material, in order to build three or more alternate reinforcement systems. Types of integration may be:

connecting the plugs at one rail to a dowel-traverse or connecting the plugs, positioned in the sleepers inside the track between two rails or connecting all plugs in the sleepers with the fastening holes for the anchor devices of the general type as sold under the trademark NELSON.

BRIEF DESCRIPTION OF THE DRAWINGS

The drawings shall specify in a detailed manner the subject of invention.

DETAILED DESCRIPTION OF PREFERRED EMBODIMENT

Figure 1:
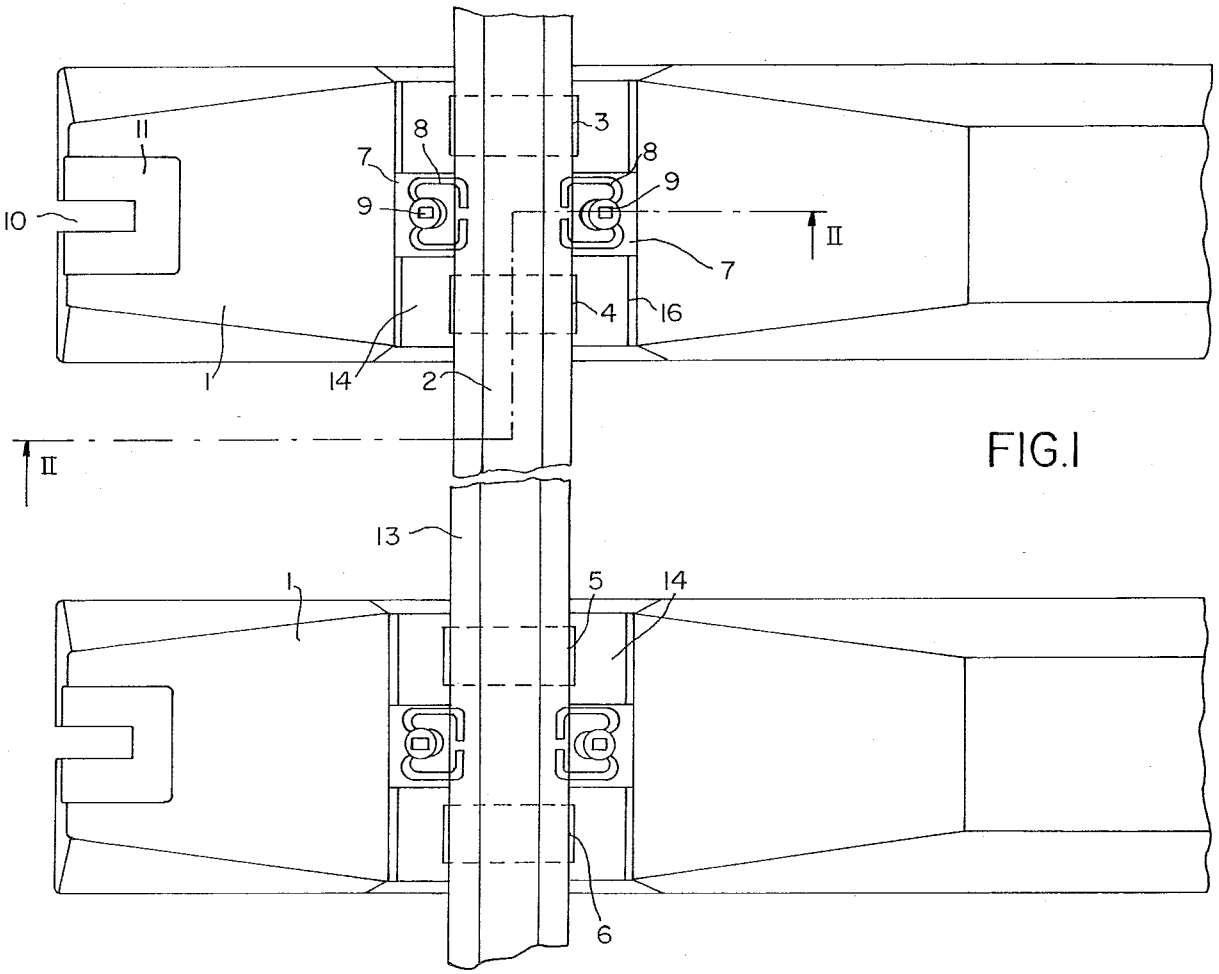
FIG. 1 shows a top view of two bar shaped ends of concrete cross sleepers according to the invention.

Two bar-shaped ends 1 of concrete cross sleepers of polymere concrete have wedge-shaped areas 14 with an incline 1:40 to the center parts of the sleepers (FIG. 1) or track. On the wedge-shaped areas 14 are arranged rail seats 3, 4, 5, 6 of resilient, electrically insulating plastic pads for the foot of rail 13 of the rail 2. The center point distance between the rail seats 4 and 5 amounts to 600 mm, and between the rails seat 3 and 4 and between the rail seats 5 and 6 amounts to 170 mm.

Figure 2:
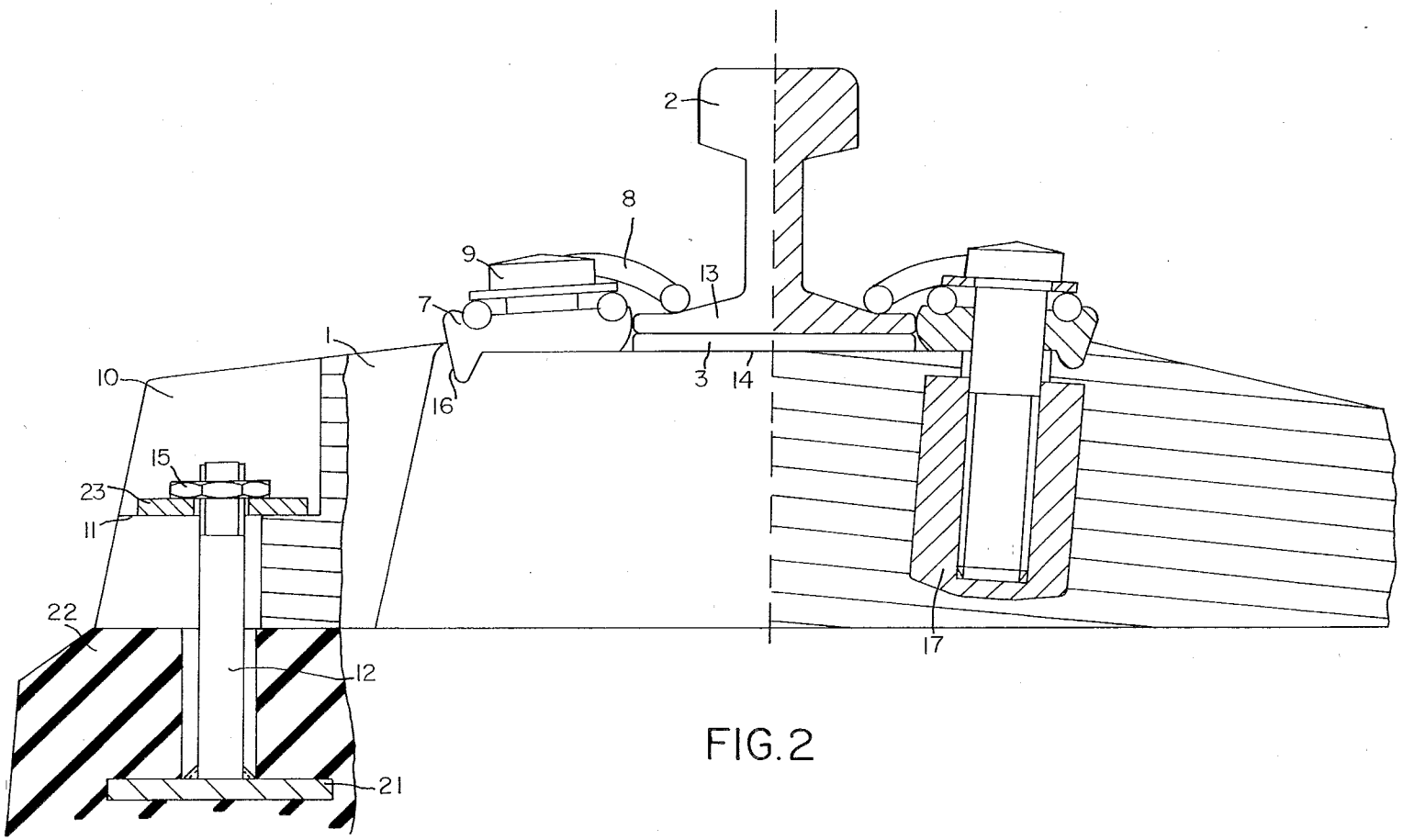
FIG. 2 shows a side view of an end of a sleeper with section II—II, according to FIG. 1.

Centered between the rail seats 3,4 and between the rail seats 5,6 the foot of rail 13 is fixed by the guiding plates 7 and springs 8 which are placed in groove 16 as well as by the screw 9 which is embedded in dowel 17 (FIG. 2).

A slit or fixing hole 10 receives the anchor device of the general type as sold under the tradeark NELSON which is fastened with nut 15 and washer 23 at the fixing point 11 (FIG. 2).

The anchor device 12 of the general type as sold under the trademark NELSON has been welded to a steel strip 21 being moulded into the asphalt bed 22.

Figure 3:
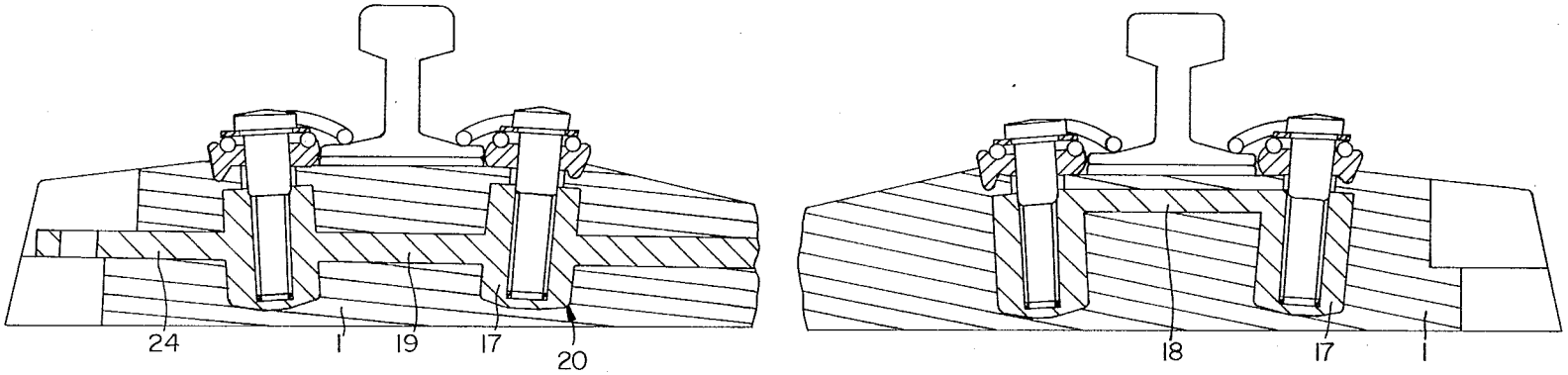
FIG. 3 shows a cross section of a concrete cross sleeper, according to the invention.

FIG. 3 illustrates a cross sectional view of a bar shaped end of this sleeper. Two different reinforcing means and dowel-traverses are shown. A dowel-traverse 18 made of glass-fibre reinforced plastic material and moulded into the bar shaped end 1 for receiving screws of the tensioning means on both sides of one rail is shown on the right part of the drawing. This assembly secures one critical point of the sleepers against cracking.

A further end of a concrete cross sleeper 1 which envelopes a reinforcing traverse 20 comprising connections 19 built from layers of glass-fiber for the plugs 17 of polyethylene material is shown on the left part of the drawing. The connections 19 extend between the ends of the sleeper and have a flange 24 with a hole for receiving an anchor device of the general type as sold under the trademark NELSON (not shown).

Figure 4:
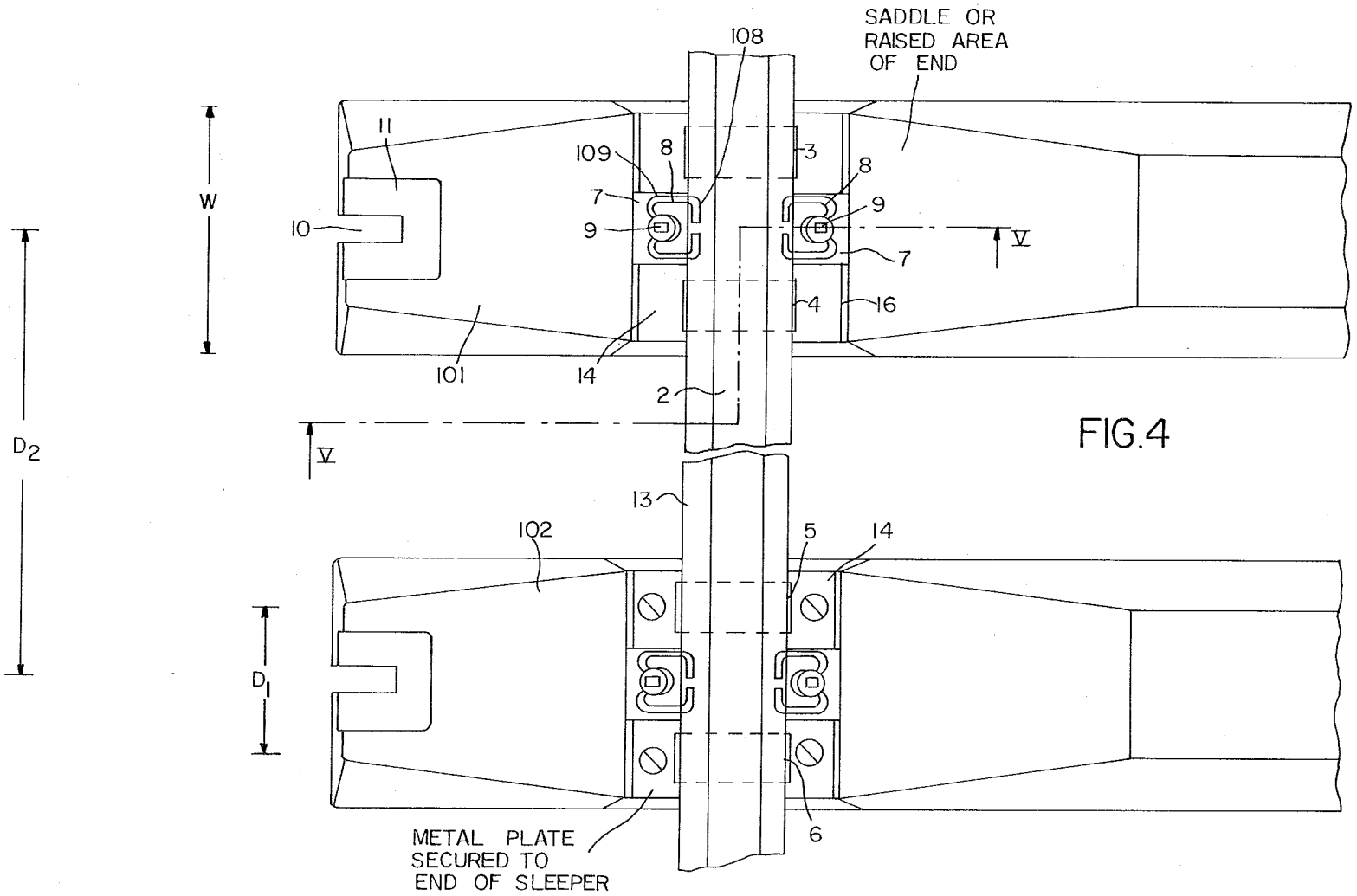
FIG. 4 shows a top view of two bar shaped ends similar to those shown in FIG. 1 including additional features of the invention.
Figure 5:
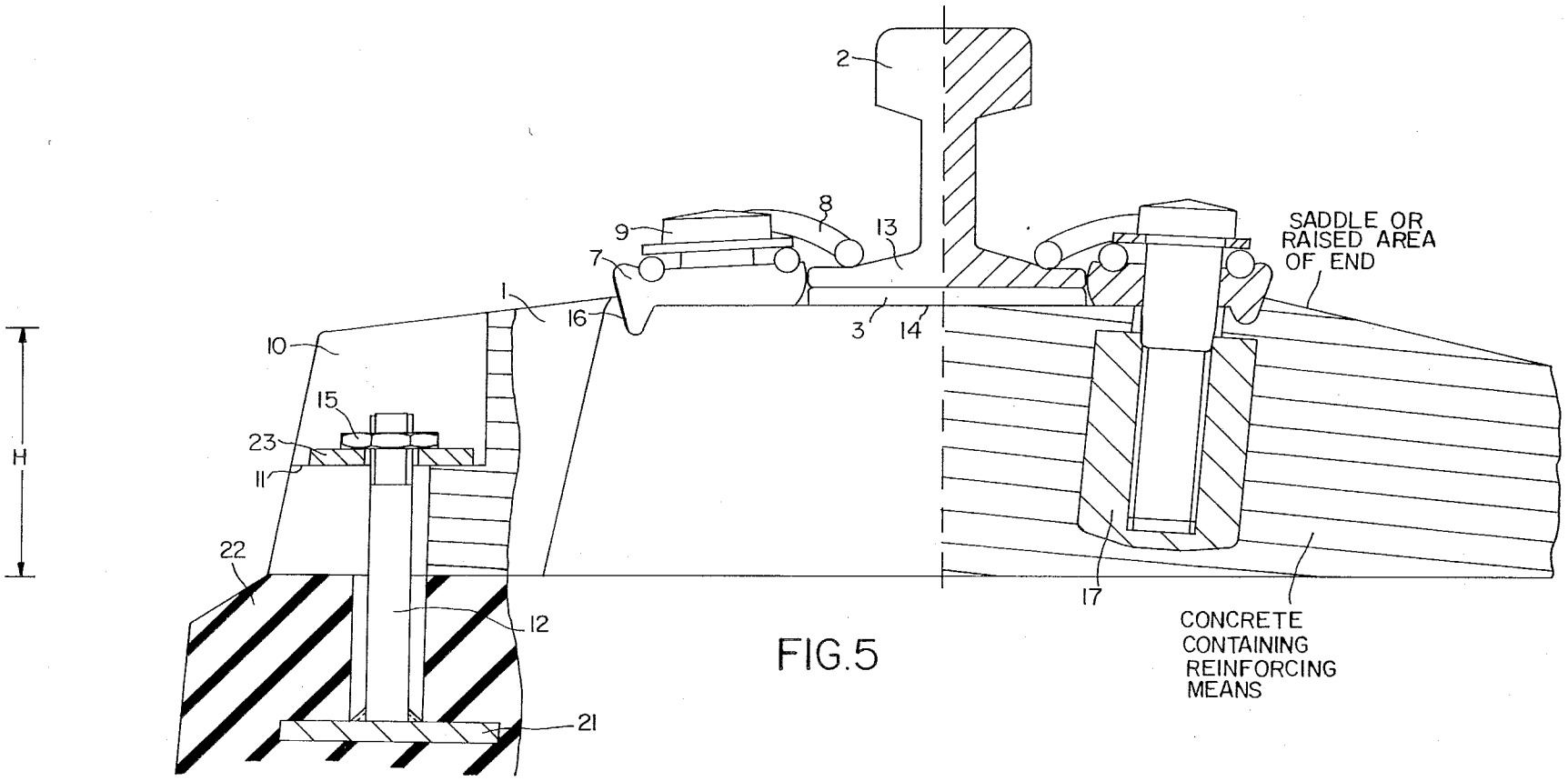
FIG. 5 shows a side view of an end of the sleeper with section V—V, according to FIG. 4.

FIGS. 4 and 5 illustrate adjacent ends 101, 102 of adjacent sleepers to demonstrate additional features of the invention. The preferred end 101 includes a width W which is less than twice the height H. Additionally, the preferred configuration includes the end 101 having a saddle or raised area for the two rail seats 3, 4. The spring 8 includes a first end 109 which is secured by the screw 9 to the end 101 and a second end 108 which is clampingly engaged with the rail 13.

An alternative end 102 includes the rail seats 5, 6 having metal plate secured to the end 102 of the sleeper by a plurality of screws. The seats 5, 6 are made of an elastic material.

Although numerous alternative designs for the ends of the sleeper may be employed, a preferred overall configuration includes, for example, two adjacent ends 101, 102 which are spaced from one another along the direction of the extension of the rail 13. The distance D1 between the center points of the two rail seats 3, 4 and 5, 6 respectively for the ends 101, 102 is greater than 20% of the distance D2 between the centers of the end 101, 102 of the sleepers.

FIG. 5 further demonstrates that the sleeper and the ends therefor can include a concrete material containing reinforcing means of the type described hereinabove.

Figure 6:
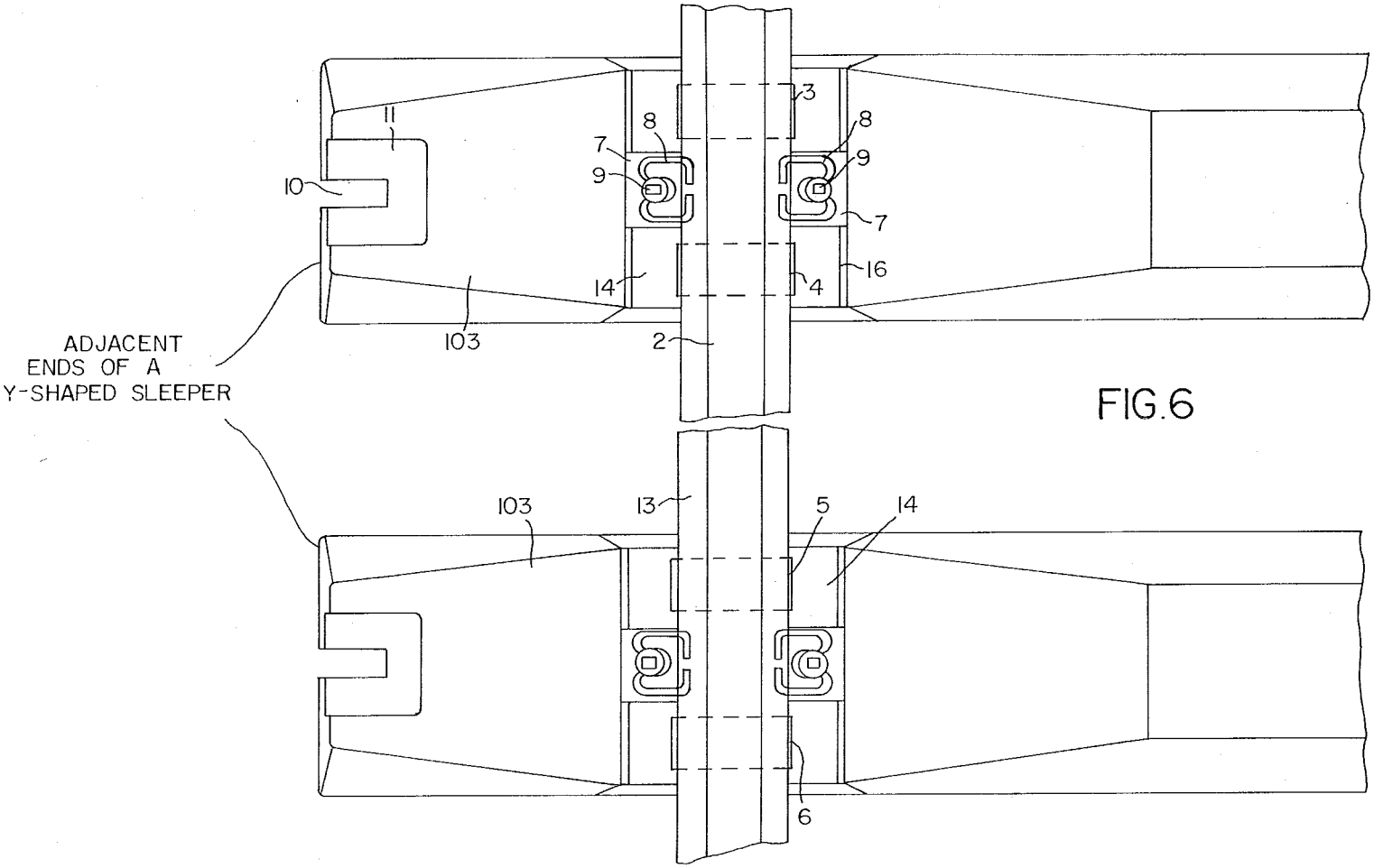
FIG. 6 shows a top view of two adjacent ends of a Y-shaped sleeper including various features of the invention.

FIG. 6 shows how two adjacent ends 103 of a Y-shaped sleeper can include the other features of the invention as described hereinabove. A Y-shaped sleeper, as mentioned above, is generally disclosed in German Offenlegungsschrift No. DE-OS 28 02 145.

We claim:

1. A cross sleeper for supporting a rail, said sleeper comprising:

an elongated member having a center portion interconnecting two ends thereof;

each of said ends being provided with two rail seats for supporting said rail, said two rail seats being spaced from one another transversely across each of said ends and along the direction of extension of said rail;

each of said two rail seats extending beneath said rail to include a portion at each side of said rail; and tension means at said each side of said rail for resiliently clamping said rail to said two rail seats, said tension means effecting said clamping action on said each side of said rail, said tension means at said each side of said rail being disposed between said portions of said two rail seats at said each sides of each said rail, whereby said tension means and said two said seats provide triple point fixing at said each side of said rail.

2. The sleeper according to claim 1, wherein the width of said ends, measured in the direction of extension of said rail, is less than twice the height of said ends.

3. The sleeper according to claim 1, wherein said two rail seats comprise saddles and an elastic material disposed over said saddles.

4. The sleeper according to claim 3, wherein said elastic material is a plastic.

5. The sleeper according to claim 1, wherein said rail seats comprise metal plates secured to said ends and an elastic material disposed over said metal plates.

6. The sleeper according to claim 1, whereinsaid two rail seats are made of an elastic material.

7. The sleeper according to claim 1, wherein said elongated member comprises concrete and further comprising a plurality of plugs having a threaded hole therein located in said ends for engaging said tension means.

8. The sleeper according to claim 1, wherein said tension means comprises a spring and a coach screw having a flanged head and a threaded end, said threaded end engaging said threaded hole in one of said plugs and said flanged head securingly clamping said spring against said rail.

9. The sleeper according to claim 1 wherein said tension means at said each side of said rail comprises a spring element having a first end secured to said end and a second end clampingly engaging said rail.

10. The sleeper according to claim 1, wherein said elongated member comprises concrete and further comprising reinforcement means disposed within said elongated member for reinforcing said interconnecting of said ends by said center portion.

11. The sleeper according to claim 10, wherein said reinforcement means comprises a polymer material intermixed with said concrete.

12. The sleeper according to claim 10, wherein said reinforcement means comprises a fiber material selected from the group consisting of carbon fiber, glass fiber and metal fiber.

13. The sleeper according to claim 1, wherein said sleeper is operably located relative to an additional said sleeper and said sleeper and said additional sleeper are spaced from one another along the direction of extension of said rail, and wherein the distance between the center points of said two rail seats on said ends of each of said sleeper and said additional sleeper is greater than 20% of the distance between the centers of said sleeper and said additional sleeper.

14. The sleeper according to claim 1, wherein said sleeper is Y-shaped so as to have two ends at a first extremity thereof and one end at the other extremity thereof, each of said three ends being provided with said two rail seats.

15. The sleeper according to claim 1, particularly adapted for bedding said sleeper onto an asphalt pavement, said pavement having a steel strip embedded therein and anchor means welded to said steel strip, said sleeper further comprising a fastening hole disposed at each of said ends for receiving said anchor means.

16. The sleeper according to claim 7, further comprising a reinforcement bar embedded in said sleeper and interconnecting each said plug provided at said each side of said rail.

17. The sleeper according to claim 15, further comprising a plug provided at said each side of said rail for engaging said tension means and a reinforcement bar embedded in said sleeper and interconnecting said fastening hole for said anchor means with said plugs.

* * * * *